United States Patent [19]

Ikeda

[11] Patent Number: 4,481,848

[45] Date of Patent: Nov. 13, 1984

[54] CORNER SHEAR MACHINE

[75] Inventor: Chihiro Ikeda, Tatsukuchi, Japan

[73] Assignee: Takeda Machinery Works Company, Ltd., Japan

[21] Appl. No.: 386,085

[22] Filed: Jun. 7, 1982

[51] Int. Cl.[3] ..... B26D 3/14

[52] U.S. Cl. ..... 83/693; 83/692

[58] Field of Search ..... 83/693, 692, 694, 683

[56] References Cited

U.S. PATENT DOCUMENTS

| | | | |
|---|---|---|---|
| 2,423,423 | 7/1947 | Feitl | 83/693 |
| 3,180,196 | 4/1965 | Coulon et al. | 83/693 X |
| 3,405,583 | 10/1968 | Herzog | 83/693 |

*Primary Examiner*—Donald R. Schran

*Attorney, Agent, or Firm*—Cushman, Darby & Cushman

[57] ABSTRACT

An improved corner shear machine including a recess which extends toward a ram across a table so that a tool assembly unit comprising a combination of a punch and a die is removably fitted into the recess. The die is firmly included in a die block and the punch is fixedly secured to a punch block, whereas the punch block is vertically displaceable toward or away from the die block with the aid of a pair of symmetrically located guide pins which stand from the latter at the rear part thereof. To allow the punch to resume the original position after completion of a shearing operation a resilient means is arranged in a suitable position in the tool assembly unit, and moreover to prevent a workpiece in the form of a sheet material from being raised up together with the punch after completion of the shearing operation a plurality of symmetrically located resilient means with stopper means fixedly secured to the lower end thereof are suspended from the punch block. A sub-table is additionally fitted into the recess in front of the tool assembly unit so that the whole recess is filled with the sub-table and the tool assembly unit.

8 Claims, 4 Drawing Figures

CORNER SHEAR MACHINE

BACKGROUND OF THE INVENTION

1. Field of the Invention

The present invention relates to a corner shear machine for cutting off a notch, slot or the like having V-shape, square or rectangular at a corner or side of a workpiece in the form of a sheet material, and more particularly relates to a corner shear machine which is removably fitted with a tool assembly unit comprising a combination of a punch and a die.

2. Description of the Prior Art

A conventional corner shear machine is constructed such that both a punch and a die are separately mounted on the machine in such a manner that the former is fixedly secured to a ram and the latter is fixedly mounted on a table. Thus, when there occurs a necessity for tool exchange in conformance to the configuration of a notch or slot to be cut off, material and thickness of the workpiece, tool exchanging work should be conducted separately for both the punch and the die. As a result a long time is required until the intended tool exchange is completed and moreover a highly skillful labor is additionally required for adjusting a clearance between the punch and the die, accompanied by a long time required also therefor.

SUMMARY OF THE INVENTION

The present invention is intended to obviate the drawbacks inherent to the conventional corner shear machine as described above. Specifically, the present invention consists in an improved corner shear machine which includes a tool assembly unit comprising a combination of a punch and a die, said tool assembly unit being removably fitted into a recess which extends across a table toward a ram.

The die is firmly contained in a die block and the punch is fixedly secured to a punch block. The punch block is vertically displaceable toward or away from the die block with the aid of a pair of symmetrically located guide pins at the rear part of the latter. To ensure that the punch block is restored to the original position after completion of an intended shearing operation a return spring is arranged in a suitable location in the tool assembly unit. Further, to ensure that the workpiece fails to be raised up together with the punch after completion of the shearing operation a plurality of cushion springs with stoppers fixedly secured to the lower ends thereof are suspended from the punch block in a symmetrical relation.

A square opening is formed on the bottom surface of the recess just beneath the ram in such a position that the tool assembly unit is fitted into the recess in vertical alignment with the ram. A sub-table is additionally fitted into the recess in front of the tool assembly unit as seen from the front side of the machine so as to fill the residual space in the recess. By rotating a clamp lever at the front side of the table the tool assembly unit is firmly mounted on the table with the aid of a thrust plate and a sub-table disposed for there. When there occurs a necessity for replacing the existing tool assembly unit with another one, the clamp lever is first disconnected from the table by rotating in the opposite direction and then both the thrust plate and the sub-table are removed from the machine and thereafter the tool assembly unit is drawn out from the groove. Now the recess on the table is ready for receiving a new tool assembly unit which has been provided so as to meet other requirements.

Thus, it is an object of the present invention to provide a corner shearing machine which is constructed such that both a punch and a die can be easily replaced with another ones at the same time.

It is other object of the present invention to provide a corner shear machine which requires no adjustment for a clearance between the punch and the die.

It is another object of the present invention to provide a corner shear machine with a tool assembly unit which has a high dimensional accuracy and is manufactured at an inexpensive cost due to dimensional standardization for both a punch block and a die block.

Other objects and advantages features of the present invention will be readily apparent from the reading of the following description made in connection with the accompanying drawings.

BRIEF DESCRIPTION OF THE ACCOMPANYING DRAWINGS

Now the present invention will be described in more details with reference to the accompanying drawings which illustrate a preferred embodiment of the invention, in which.

Figure 1:
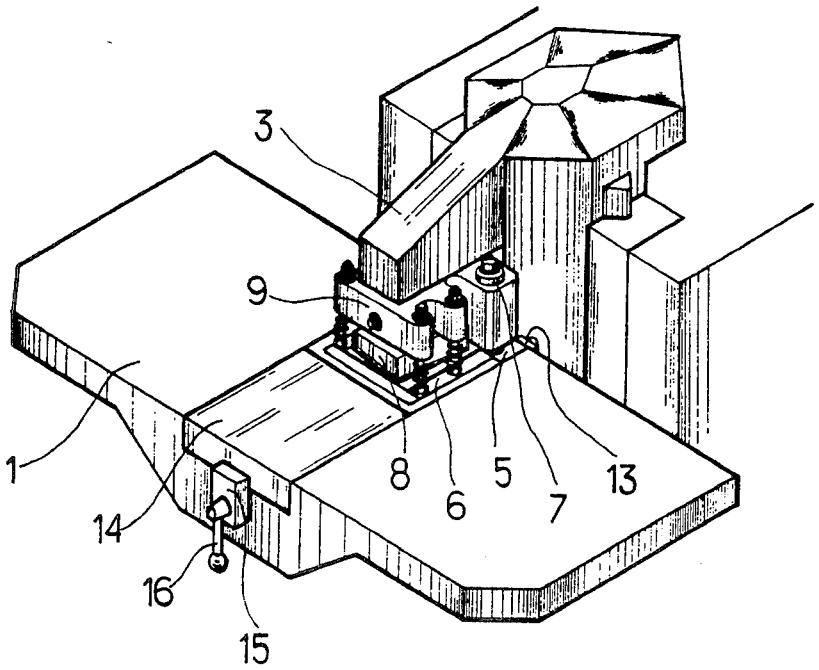
FIG. 1 is a perspective view of a corner shear machine in accordance with the present invention, wherein insignificant parts and components for the present invention are eliminated from the drawing for the purpose of simplification.
Figure 2:
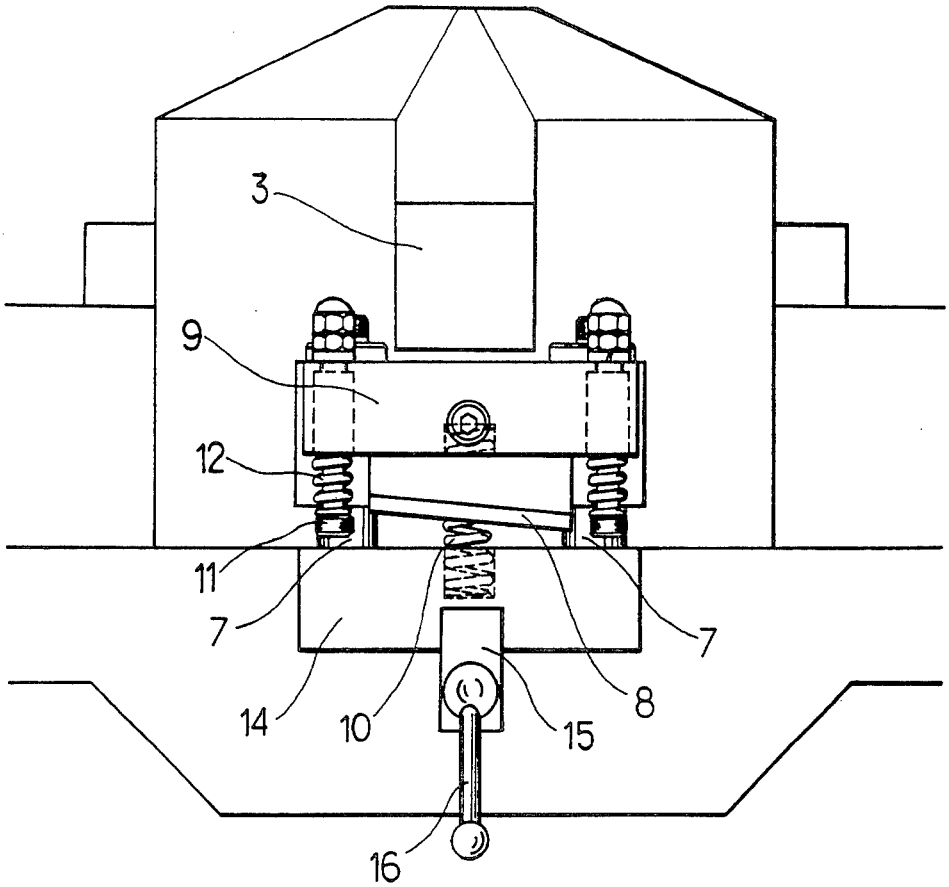
FIG. 2 is a partial front view of the corner shear machine in FIG. 1, shown in a considerably larger scale.
Figure 3:
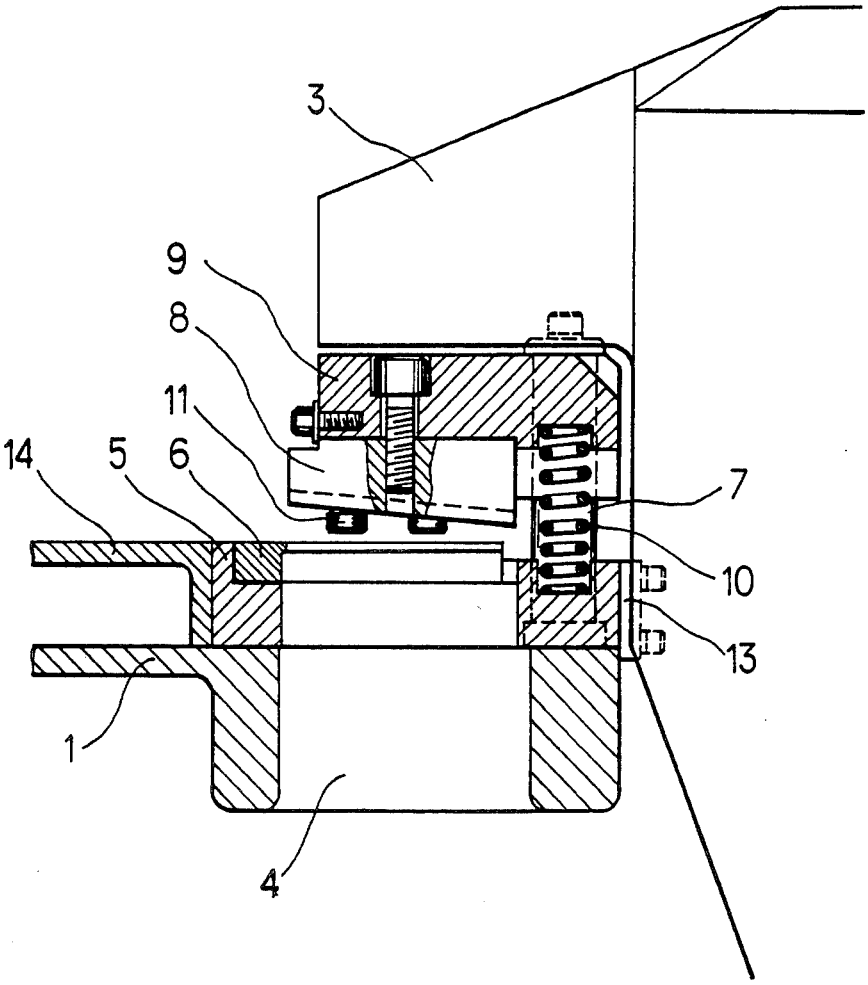
Figure 4:
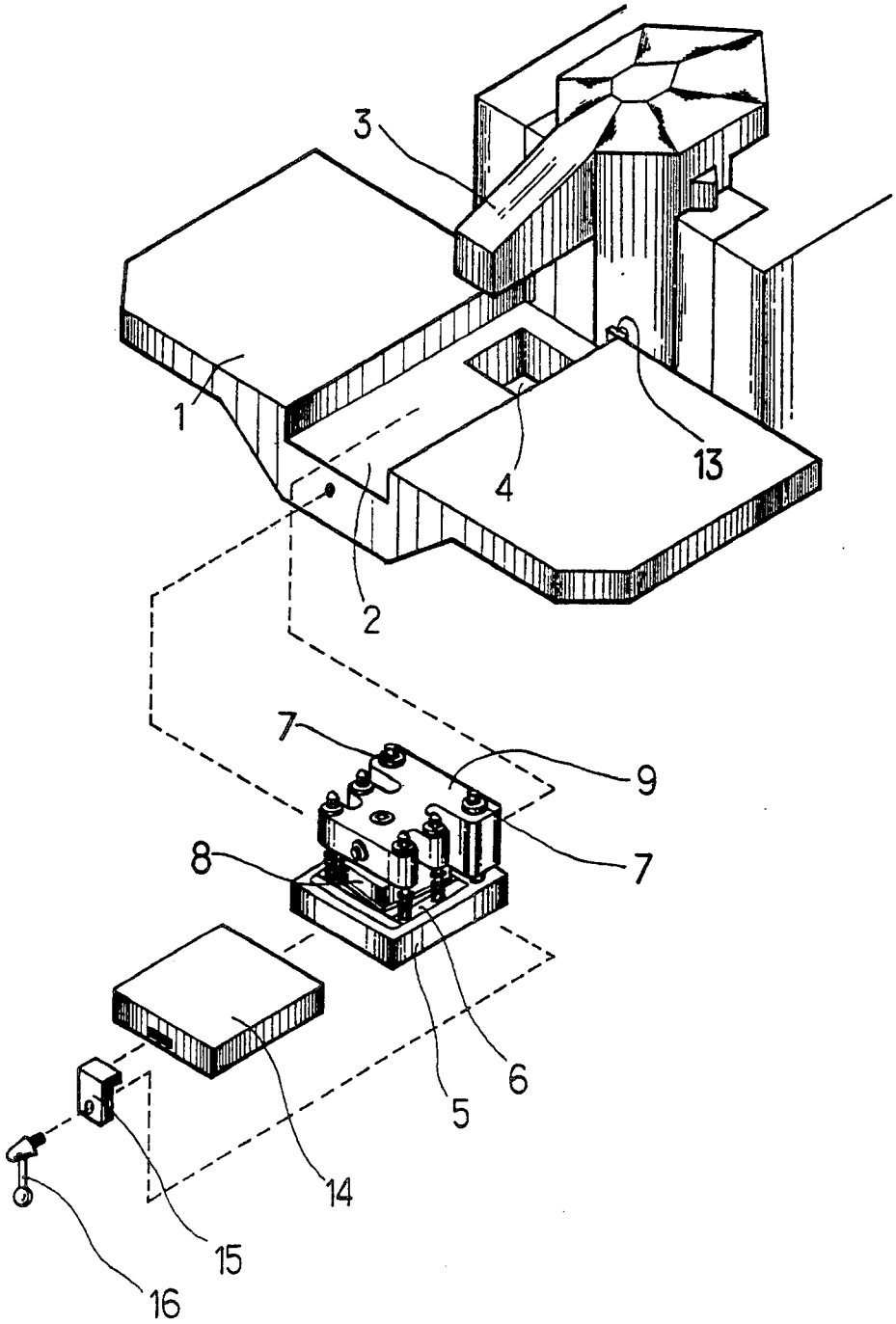

FIG. 3 is a partial vertical sectional view of the corner shear machine, particularly illustrating a tool assembly unit which forms an essential part of the invention, shown in a scale a little larger than FIG. 2, and FIG. 4 is a perspective view of the corner shear machine similar to FIG. 1, illustrating the tool assembly unit and associated parts and components removed from a table to be shown in a disassembled state.

DETAILED DESCRIPTION OF THE PREFERRED EMBODIMENT

As is best seen from FIG. 4 of the drawings, the corner shear machine of the invention includes a table 1 on which a groove 2 is provided so as to receive a tool assembly unit to be described later and associated parts and components, said groove 2 extending toward a ram 3 across the table 1. Further, the groove 2 is formed with a square opening 4 which is located in alignment with the downward movement of the ram 3.

In the drawing reference numeral 5 designates a die block in which a die 6 is firmly contained, said die block 5 being provided with a pair of guide pins 7 at the rear part which stand therefrom in a symmetrical relation. A punch block 9 with a punch 8 fixedly secured thereto is displaceably mounted on the pair of guide pins 7, said punch 8 being located in exact alignment with the die 6.

As is apparent from FIGS. 2 and 3, a return spring 10 is resiliently disposed between the die block 5 and the punch block 9 and moreover a plurality of cushion springs 12 are suspended from the punch block 9 with stoppers 11 fixedly secured to the lower end of the respective cushion springs 12. It should be noted that a part of the respective cushion springs 12 is included into the punch block 9. Reference numeral 13 designates a backup plate and reference numeral 14 does a sub-table which is adapted to be fitted into the groove 2 in front of the die block 5 as seen from the front side of the machine.

Further, in the drawing reference numeral 15 designates a thrust plate and reference numeral 16 does a clamp lever.

Now assembling and operation of the corner shear machine constructed in the above-mentioned manner will be described below.

First, the tool assembly unit comprising the punch 8 and the die 6 assembled one above another is fitted into the groove 2 from the front side of the machine and then is located above the square opening 4. Then, the sub-table 14 is fitted into the same groove 2 until it comes in abutment against the front side of the tool assembly unit, and thereafter the clamp lever 16 is rotated so as to screw the threaded portion thereof into a threaded hole on the sub-table 14 with the thrust plate 15 disposed between the sub-table 14 and the clamp lever 16. Thus, the tool assembly unit is firmly mounted in the groove 2 on the table by tightly rotating the clamp lever 16.

After completion of assembling of the tool assembly unit in that way a workpiece in the form of a sheet material is placed on the die 6 and then the ram 3 starts to move in the downward direction. As the ram 3 depresses the punch block 9 at the upper face thereof, the punch block 9 moves downward while it is guided by means of the pair of guide pins 7, whereby shearing is effected for the workpiece by means of the combination of the punch 8 and the die 6. When the intended shearing operation is completed and thereafter the ram 3 is raised up, the punch block 9 moves upward to resume the original position under the resilient force given by the return spring 10 located between the die block 5 and the punch block 9. Now the corner shear machine is ready to initiate a next shearing operation.

As described above, owing to the arrangement that the corner shear machine of the invention includes the punch block 9 which is equipped with the plural cushion springs 12 with the stoppers 11 fixedly secured to the lower end parts thereof, it is ensured that the workpiece is perfectly prevented from being raised together with the punch 8. Further, since the tool assembly unit is constructed as a single unit consisting of a combination of a punch and a die, it is ensured that any replacement work is easily conducted in a simple one-touch operation when there occurs a necessity for exchanging the existing tool assembly unit with another one depending on a thickness of a workpiece to be sheared. It should be noted that any replacement work is conducted within a shorter period of time at an increased operational efficiency without any necessity for adjusting a clearance between the punch and the die as is the case with the conventional corner shear machine.

It should be of course understood that the present invention has been described above only with respect to a preferred embodiment of the invention but it should be not limited only to this and many changes or modifications may be made without any departure from the spirit and the scope of the invention.

What is claimed is:

1. A corner shearing machine for cutting off a notch, slot or the like having a V-shaped, square or rectangular configuration at a corner or side of a workpiece in the form of a sheet material, said corner shearing machine comprising:

a reciprocal ram;

a table defining a recessed channel extending toward said ram across the table and a square opening defined in a bottom surface of said recessed channel, said ram and said table being separated from one another to define a space therebetween; and a modular tool assembly unit removably mounted in said recessed channel in said space between said ram and said table and in a position located above said square opening, said modular tool assembly unit including a punch block having a punch fixed thereto, a die block defining a die cavity, mounting means for mounting said punch and die blocks in opposing separated relationship to one another and for permitting said punch block to be reciprocally vertically displaced relative to said die block in response to reciprocation of said ram, said punch being displaceable between a displaced position and a punch position wherein said workpiece is sheared, and biasing means for biasing said punch block in a direction towards said displaced position tending to separate said punch and die blocks, and wherein said modular tool assembly unit is integrally removable from said corner shearing machine so as to permit replacement thereof by another modular tool assembly unit.

2. A corner shear machine as defined in claim 1, wherein said mounting means includes a pair of symmetrically located guide pins fixed to said die block at a rear part thereof and slidably received by said punch block.

3. A corner shear machine as defined in claim 2, wherein said punch block includes a plurality of symmetrically located separation means projecting from said punch block toward the die block, each said separation means terminating in a stopper member which is vertically spaced from said workpiece when said punch block is in said displaced position, said separation means for preventing said workpiece from being upwardly carried by said punch block during movement thereof, subsequent to a shearing operation, from said punch position to said displaced position and for separating said workpiece from said punch.

4. A corner shearing machine as in claim 1 wherein said table includes a vertically disposed back plate, a sub-table slidably received in said recessed channel, said modular tool assembly unit being mounted between said back plate and said sub-table, and clamping means for removably fixing said sub-table to said table and for clamping said modular tool assembly unit between said back plate and said sub-table.

5. A corner shearing machine as in claim 4 wherein said sub-table defines a slot and wherein said clamping means includes an L-shaped thrust plate having a leg thereof disposed in said slot, the other leg of said thrust plate defining an aperture, and a threaded clamp lever disposed in said aperture and threadably engaged with said table so that upon turning movement thereof said sub-table clamps said modular tool assembly unit by virtue of said thrust plate.

6. A corner shearing machine as in claim 3 wherein said table includes a vertically disposed back plate, a sub-table slidably received in said recessed channel, said modular tool assembly unit being mounted between said back plate and said sub-table, and clamping means for fixing said sub-table to said table and for clamping said modular tool assembly unit between said back plate and said sub-table.

7. A corner shearing machine for shearing a sheet workpiece comprising:

a table defining an elongated recessed channel;

a ram receiprocally moveable between upper and lower positions and vertically disposed above said table in alignment with said channel; and a modular tool assembly unit removably mounted in said channel between said ram and said table, said unit including a punch block having a punch member fixed thereto, a die block defining a die cavity for receiving said punch member, mounting means for mounting said punch and die blocks in opposing separated relationship, said punch block being mounted between said die block and said ram, said mounting means for permitting said punch block to be vertically displaced, in response to said ram moving between said upper and lower positions, respectively, between a displaced position wherein a space is defined between said punch member and said die cavity to permit insertion of the workpiece therein and a punch position wherein said punch member is received in said die cavity to thereby shear the workpiece, and biasing means for biasing said punch block in a direction towards said displaced position, wherein said punch block includes separation means downwardly projecting from said punch block for preventing said workpiece from being upwardly carried by said punch member when said punch block moves from said punch position to said displaced position and for separating said workpiece from said punch member, whereby said modular tool assembly unit is integrally removable from said channel to permit replacement thereof by another modular tool assembly unit.

8. A corner shearing machine as in claim 7 wherein said separating means includes plural symmetrically disposed rod members slidably received in said punch block each terminating in a stopper member which is disposed above said die block to define therewith an area in which the workpiece can be inserted, and spring means associated with each said rod member for biasing each said stopper member towards said die block.

* * * * *